United States Patent [19]

Prince

[11] Patent Number: 5,062,516

[45] Date of Patent: Nov. 5, 1991

[54] SINGLE LEVER CONTROL

[75] Inventor: Anthony P. Prince, Waukegan, Ill.

[73] Assignee: Outboard Marine Corporation, Waukegan, Ill.

[21] Appl. No.: 494,789

[22] Filed: Mar. 12, 1990

Related U.S. Application Data

[63] Continuation of Ser. No. 201,378, May 27, 1988, abandoned, which is a continuation of Ser. No. 738,183, May 28, 1985, abandoned.

[51] Int. Cl.[5] ..... B60K 41/02

[52] U.S. Cl. ..... 192/0.096; 74/480 B

[58] Field of Search ..... 192/0.096; 74/473 P, 74/480 R, 480 B; 440/1, 2, 84, 85, 86, 87

[56] References Cited

U.S. PATENT DOCUMENTS

| | | | |
|---|---|---|---|
| 1,495,273 | 5/1924 | Svenson | 248/27.1 |
| 3,127,785 | 4/1964 | Morse et al. | 192/0.096 |
| 3,140,689 | 7/1964 | Miner | 440/2 |
| 3,292,568 | 12/1966 | Morrell | 440/1 |
| 3,438,468 | 4/1969 | Hemens | 192/0.096 |
| 3,613,632 | 10/1971 | Farrell | 74/471 R |
| 3,651,709 | 8/1968 | Booty et al. | 74/483 R |
| 3,780,842 | 12/1973 | Whipple et al. | 192/0.096 |
| 3,786,892 | 9/1964 | Horton | 180/99 |
| 3,898,398 | 5/1969 | Borst et al. | 200/44 |
| 4,106,604 | 8/1978 | Baba | 74/527 |
| 4,119,186 | 10/1978 | Choudhury et al. | 192/0.096 |
| 4,222,474 | 9/1980 | Choudhury et al. | 192/0.096 |
| 4,232,771 | 11/1980 | Prince | 192/0.096 |
| 4,253,349 | 3/1981 | Floeter et al. | 192/0.096 |
| 4,470,492 | 11/1984 | Kobelt | 192/0.096 |
| 4,557,224 | 12/1985 | Dubois | 123/148 D |
| 4,632,232 | 12/1986 | Kolb et al. | 192/0.096 |
| 4,648,497 | 3/1987 | Prince | 192/0.096 X |

FOREIGN PATENT DOCUMENTS

| | | |
|---|---|---|
| 3543326A1 | 6/1987 | Fed. Rep. of Germany . |
| 2256319 | 7/1975 | France . |
| 1461514 | 1/1977 | United Kingdom . |

OTHER PUBLICATIONS

Johnson Remote Control Assembly, Dwg No. 385,505, 12/1973, Outboard Marine Corporation.

Drawing From Outbard Marine Corporation Nos. 279336, 317930, 386605, 386867, 387371, 388174, 388175, 389031, 389089, 389117, 392051, 393081, 394084, 394525, 395307, 396105, 397183, 397184, 432716, and 432718.

*Primary Examiner*—Richard Lorence

*Attorney, Agent, or Firm*—Michael, Best & Friedrich

[57] ABSTRACT

A single level control comprising a housing, a control lever pivotally mounted on the housing and adapted to be operably connected to an engine throttle and to a clutch, a warning horn connected to the housing and adapted to be operably connected to an engine for providing a warning signal when an engine condition exceeds a predetermined value, a cover connected to the housing and adapted to be mounted on a generally flat mounting surface, the cover partially enclosing the housing and enclosing the warning horn, and an ignition switch mounted on the cover and adapted to be operably connected to an engine ignition system.

11 Claims, 3 Drawing Sheets

SINGLE LEVER CONTROL

This is a continuation of Ser. No. 201,378, filed May 27, 1988 and now abandoned, which is a continuation of Ser. No. 738,183, filed May 28, 1985 and now abandoned.

BACKGROUND OF THE INVENTION

The invention relates to control devices for internal combustion engines, and more particularly to single lever binnacle controls for marine propulsion devices. It is known to provide single lever binnacle controls on certain marine vehicles for operating the throttle and/or the clutch of the marine vehicle propulsion device. It is also known to provide other types of single lever controls on marine vehicles.

Additionally, it is known to provide an ignition switch (either an on/off switch or a cut-out switch) mounted on or connected to a single lever control.

Attention is directed to the following U.S. Pat. Nos. which disclose single lever controls or ignition switches: Borst U.S. Pat. No. 3,898,398, issued Aug. 5, 1975; Horton U.S. Pat. No. 3,786,892, issued Jan. 22, 1974; and Booty U.S. Pat. No. 3,651,709, issued Mar. 28, 1972.

SUMMARY OF THE INVENTION

The invention provides a single lever binnacle control comprising a housing, a control lever pivotally mounted on the housing and adapted to be operably connected to an engine throttle and to a clutch, warning means connected to the housing and adapted to be operably connected to an engine for providing a warning signal when an engine condition exceeds a predetermined value, a cover connected to tne housing and adapted to be mounted on a generally flat mounting surface, the cover partially enclosing the housing and enclosing the warning means, and an ignition switch mounted on the cover and adapted to be operably connected to an engine ignition system.

In one embodiment, the ignition switch is an on/off ignition switch, and tne binnacle control further comprises an ignition cut-out switch mounted on the cover and adapted to be operably connected to the engine ignition system.

In one embodiment, the mounting surface is generally horizontal and has an opening therein, the housing is adapted to extend through the opening and includes an upper portion adapted to extend above the mounting surface, and a lower portion adapted to extend below the mounting surface, the control lever is pivotally mounted on the upper portion of the housing, and the cover encloses the upper portion of the housing.

In one embodiment, the binnacle control further comprises a mounting bracket including a vertical portion fixedly connected to the lower portion of the housing and adapted to extend through the opening, and a horizontal portion adapted to be connected to the mounting surface adjacent the opening, the warning means is mounted on the horizontal portion of the mounting bracket, and the cover encloses the horizontal portion of the mounting bracket and is adapted to be fixedly connected with the horizontal portion of the mounting bracket to the mounting surface.

In one embodiment, the housing includes a flange extending generally horizontally from tne first side of the upper portion and being adapted to be connected to the mounting surface adjacent the opening, and the cover encloses the flange and includes a portion in registry with the flange and adapted to be connected with the flange to tne mounting surface.

In one embodiment, the warning means includes an electric horn operable in response to an engine temperature above a predetermined value.

In one embodiment, the warning means and the ignition switch are electrically operated, and the binnacle control further comprises electrical wiring operably connected to each of the warning means and the ignition switch and adapted to be operably connected to a marine propulsion device.

The invention also provides a single lever binnacle control adapted to be mounted on a generally horizontal mounting surface having an opening therein, the binnacle control comprising a housing adapted to extend through the opening, a control lever pivotally mounted on tne housing and adapted to be operably connected to an engine throttle and to a clutch, a mounting bracket fixedly connected to the housing and including a vertical portion fixedly connected to the housing and adapted to extend through the opening, and a horizontal portion adapted to be connected to the mounting surface adjacent the opening, and warning means mounted on the horizontal portion of the mounting bracket and adapted to be operably connected to an engine for providing a warning signal when an engine condition exceeds a predetermined value.

The invention also provides a single lever binnacle control adapted to be mounted on a generally horizontal mounting surface having an opening therein, the binnacle control comprising a housing adapted to extend through the opening and including an interior, opposite first and second sides, an upper portion adapted to extend above the mounting surface, a lower portion adapted to extend below the mounting surface, and a flange extending generally horizontally from the first side of the upper portion and being adapted to be connected to the mounting surface adjacent the opening, a control lever pivotally mounted on the upper portion of the housing, a throttle lever movably mounted inside the housing and adapted to be operably connected to a push-pull cable for actuating a marine engine throttle, means operably connecting tne control lever to the throttle lever for causing movement of the throttle lever in response to pivotal movement of the control lever, a shift lever movably mounted inside the housing and adapted to be operably connected to a push-pull cable for actuating a marine engine clutch, and means operably connecting the control lever to the shift lever for causing movement of the shift lever in response to pivotal movement of the control lever. The binnacle control also comprises a mounting bracket including a vertical portion fixedly connected to the second side of said lower portion of tne housing and adapted to extend through the opening, and a horizontal portion adapted to be connected to the mounting surface adjacent the opening, and an electrically operated warning horn mounted on the horizontal portion of the mounting bracket and adapted to be operably connected to a marine engine for providing a warning signal when the temperature of the engine exceeds a predetermined value. The binnacle control further comprises a cover enclosing tne upper portion of the housing, the flange, the horizontal portion of the mounting bracket, and the warning horn, the cover being adapted to be fixedly connected with tne flange and with the horizontal portion of the mounting bracket to the mounting surface, and the cover including a slot receiving the control lever and facilitating placement of the cover over the housing and the control lever. The binnacle control further comprises an electrically operated ignition cut-out switch mounted on the cover and adapted to be operably connected to a marine engine ignition system, an electrically operated on/off ignition switch mounted on tne cover and adapted to be operably connected to the marine engine ignition system, and electrical wiring operably connected to each of the warning horn, the cut-out switch, and the on/off switch and adapted to be operably connected to a marine propulsion device.

A principal feature of the invention is the provision of a single lever binnacle control comprising, in part, warning means connected to a housing and adapted to be operably connected to an engine for providing a warning signal when an engine condition exceeds a predetermined value, a cover connected to tne housing and partially enclosing tne housing and enclosing the warning means, and an ignition switch mounted on tne cover and adapted to be operably connected to an engine ignition system. Thus, the invention provides a remote control lever, warning means, and an ignition switch all on a single device.

Another principal feature of the invention is the provision of a single lever binnacle control comprising, in part, a mounting bracket fixedly connected to a housing and including a vertical portion fixedly connected to the housing and adapted to extend through an opening in a horizontal mounting surface, and a horizontal portion adapted to be connected to the mounting surface adjacent the opening, and warning means mounted on the horizontal portion of the mounting bracket. The mounting bracket provides an improved means of mounting a control lever housing and warning means on a mounting surface.

Other principal features and advantages of the invention will become apparent to those skilled in the art upon review of the following detailed description, claims, and drawings.

Figure 2:
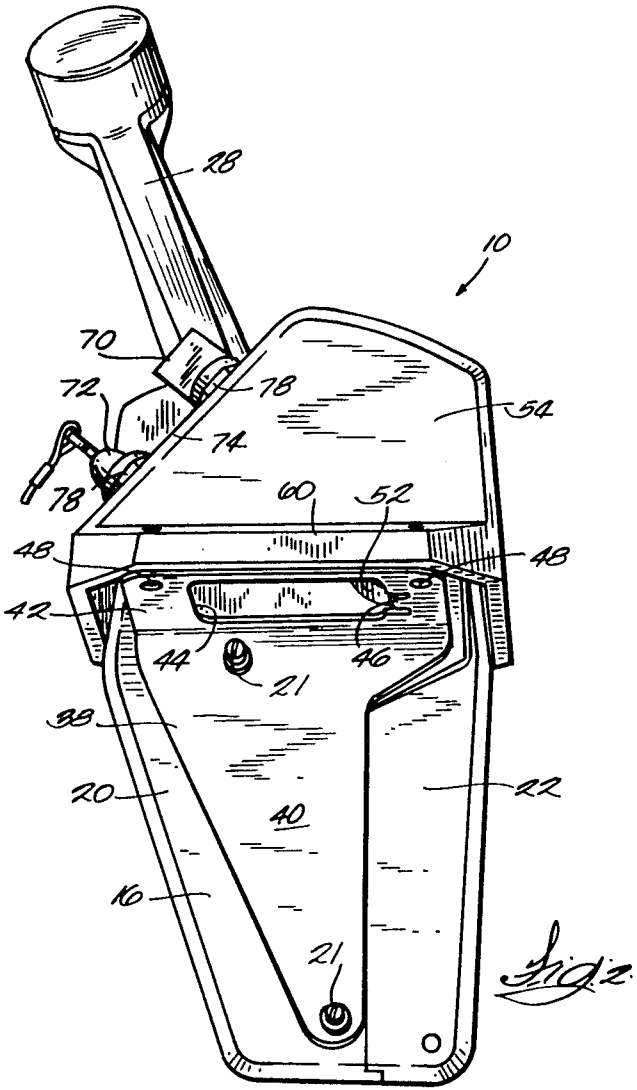
FIG. 2 is a perspective view, looking upwardly, of the right side of the binnacle control shown in FIG. 1.
Figure 1:
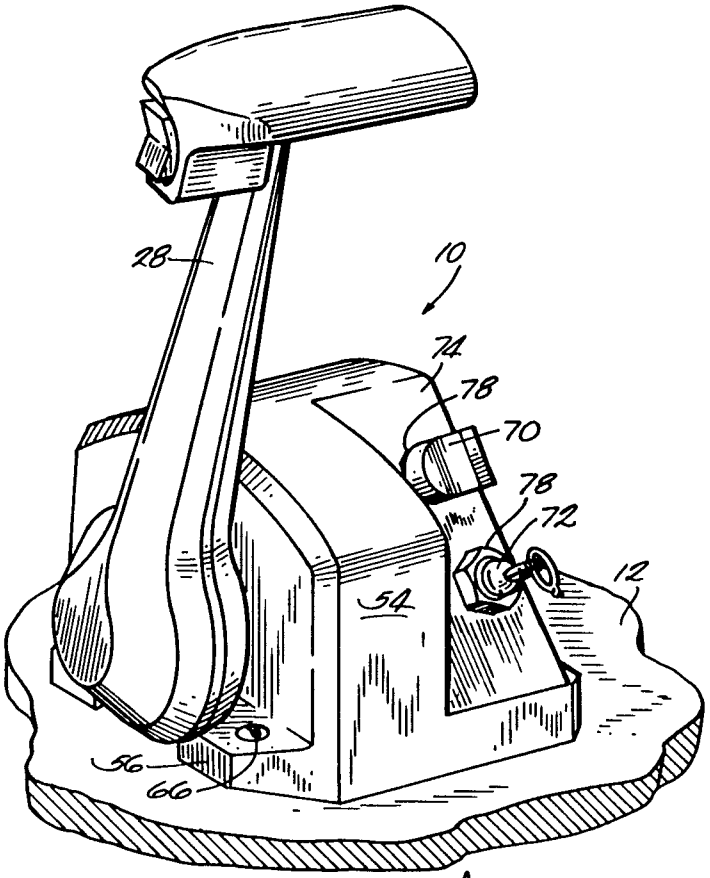
FIG. 1 is a perspective view of a single lever binnacle control embodying the invention.

Before one embodiment of the invention is explained in detail, it is to be understood that tne invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A single lever binnacle control 10 embodying the invention is shown in tne drawings. As best shown in FIGS. 1 and 3 through 5, the binnacle control 10 is preferrably mounted on a generally horizontal mounting surface 12 having an opening 14 therein.

Figure 6:
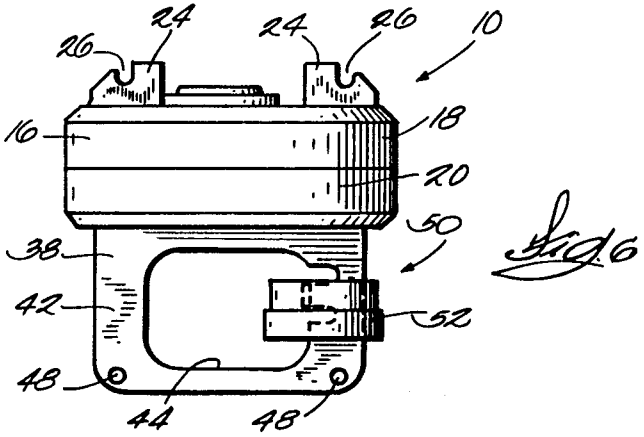
FIG. 6 is a top view of the binnacle control with the cover and control lever removed.

The binnacle control 10 comprises a housing 16 (FIGS. 3 and 4) extending through the opening 14 and including an upper portion extending above the mounting surface 12, and a lower portion extending below the mounting surface 12. In the preferred embodiment, the housing 16 comprises generally symmetrical first and second or left and right housing portions 18 and 20, respectively, secured together by bolts 21. This construction is known in tne art. Preferably, in order to facilitate assembly of the binnacle control 10, the housing 16 further comprises a third portion 22 attached to the rear (to the right in FIG. 3) of the left and right housing portions 18 and 20 and closing tne housing 16. It should be understood that any other suitable housing construction is within the scope of the invention. Tne housing 16 preferably also includes (see FIG. 6) a pair of flanges 24 extending generally horizontally from the upper portion of the left housing portion 18 and abutting the mounting surface 12 adjacent the opening 14. As best shown in FIG. 6, the flanges 24 preferably have slots 26 therein.

The binnacle control 10 also comprises a control lever 28 pivotally mounted on the housing 16, a throttle lever 30 (FIG. 5) pivotally mounted inside the housing 16 and adapted to be operably connected to a push-pull cable (not shown) for actuating a marine engine throttle, and a shift lever 32 pivotally mounted inside the housing 16 and adapted to be operably connected to a push-pull cable (not shown) for actuating a marine engine clutch.

Figure 5:
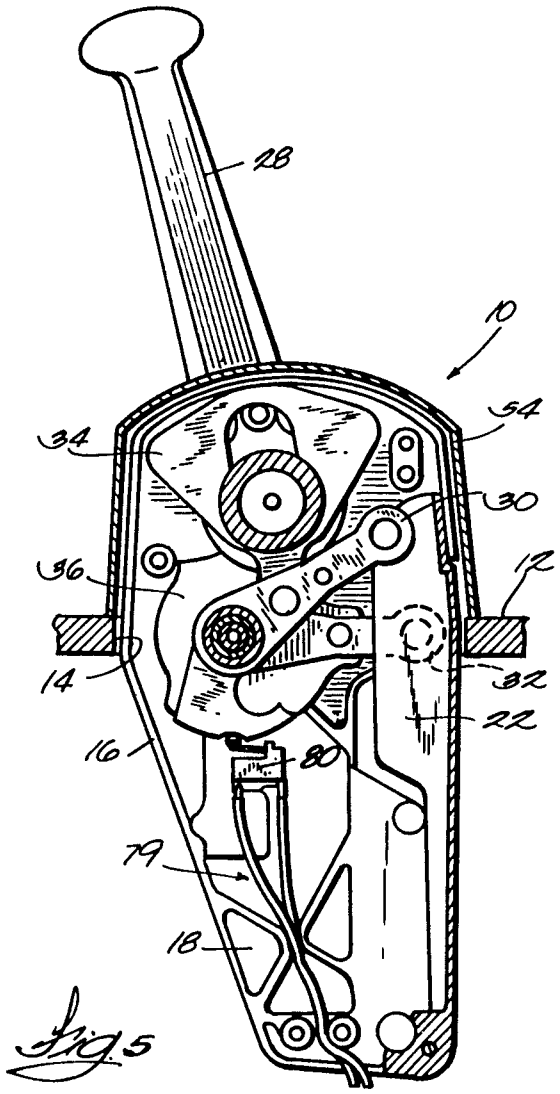
FIG. 5 is a cross-sectional view taken along line 5—5 in FIG. 4.

The binnacle control 10 also comprises means operably connecting the control lever 28 to the throttle lever 30 for causing pivotal movement of tne throttle lever 30 in response to pivotal movement of the control lever 28, and means operably connecting the control lever 28 to the shift lever 32 for causing pivotal movement of the shift lever 32 in response to pivotal movement of the control lever 28. In the preferred embodiment, as shown in FIG. 5, these means include conventional linkage means including a cam member 34 slidably mounted on the housing 16 and operably connected between the control lever 28 and the throttle lever 30, and a shift member 36 rotatably mounted on the housing 16 and operably connected between the control lever 28 and the shift lever 32. A similar linkage is disclosed in U.S. Pat. No. 4,195,534, which is incorporated herein by reference.

The binnacle control 10 further comprises a mounting bracket 38 (FIGS. 2–4) including a vertical portion 40 fixedly connected to the lower portion of tne housing 16 and extending through the opening 14, and a horizontal portion 42 connected to the mounting surface 12 adjacent the opening 14. In the illustrated construction, the vertical portion 40 of the mounting bracket 38 is connected to tne lower portion of the right housing portion 20 by the bolts 21. In tne preferred embodiment, the horizontal portion 42 of the mounting bracket 38 includes (see FIG. 6) an opening 44, an upwardly extending tab 46 (FIG. 4), and openings 48. The reasons for these are set forth hereinafter.

The binnacle control 10 further comprises warning means 50 connected to tne housing 16 and adapted to be operably connected to an engine for providing a warning signal when the temperature of the engine exceeds a predetermined value. Such warning means are known in the art. In tne preferred embodiment, the warning means 50 includes an electric horn 52 mounted on the tab 46 of the mounting bracket 38.

Figure 4:
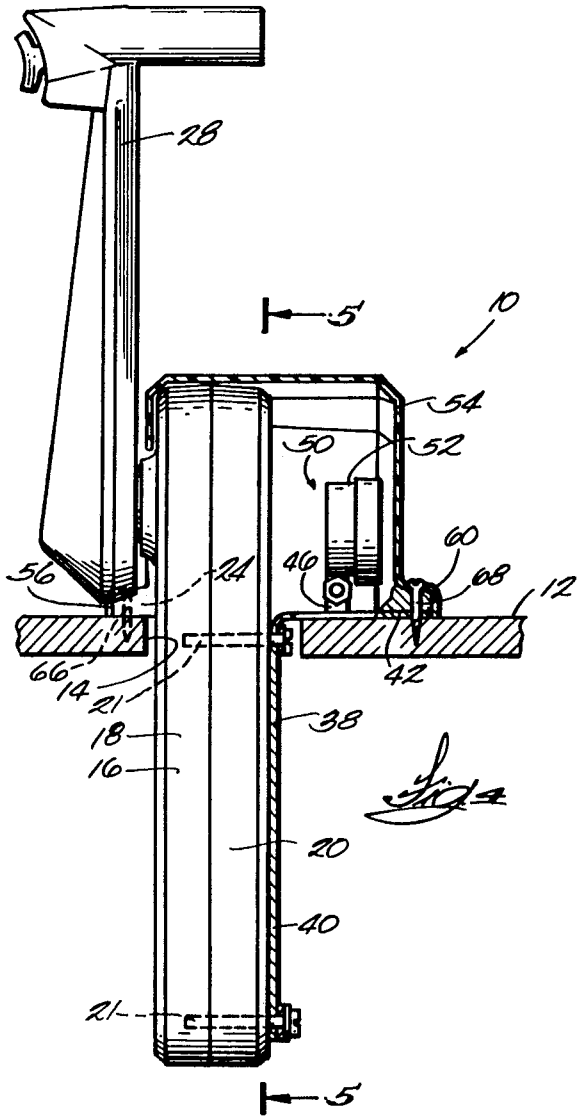
FIG. 4 is a front view, partially cut away, of tne binnacle control.

The binnacle control 10 further comprises a cover 54 connected to the housing 16 and mounted on the mounting surface 12. As best shown in FIG. 4, the cover 54 partially encloses the housing 16 and encloses the warning horn 52, the flanges 24, and the horizontal portion 42 of the mounting bracket 38. The cover 54 is fixedly connected with the horizontal portion 42 of the mounting bracket 38 to the mounting surface 12, and the cover 54 includes portions in registry with the flanges 24 and connected with the flanges 24 to the mounting surface 12.

Figure 7:
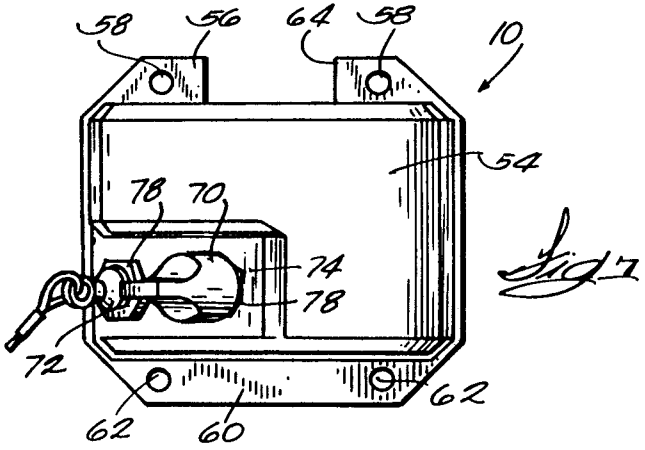
FIG. 7 is a top view of the binnacle control with the control lever removed.

As best shown in FIGS. 4 and 7, the cover 54 includes a left flange portion 56 enclosing the flanges 24 of the housing 16 and including openings 58 aligned with tne slots 26 in the flanges 24. The cover 54 also includes a right flange portion 60 enclosing the end of the mounting bracket horizontal portion 42 and including openings 62 aligned with the openings 48 in the mounting bracket horizontal portion 42. As best shown in FIG. 7, the left flange portion 56 includes a slot 64 which allows the cover 54 to be placed over the housing 16 with the control lever 28 passing through the slot 64. The cover 54, the flanges 24 and the mounting bracket horizontal portion 42 are preferrably connected to the mounting surface 12 by screws 66 inserted through the openings 58 in the cover 54 and the slots 26 in the flanges 24 and threaded into the mounting surface 12, and by screws 68 inserted through the openings 62 in the cover 54 and the openings 48 in the mounting bracket 38 and threaded into the mounting surface 12.

The binnacle control 10 further comprises an on/off ignition switch 70 and an ignition cut-out switch 72 both mounted on the cover 54 and adapted to be operably connected to an engine ignition system. The two ignition switches can be of any suitable construction. An example of a suitable on/off switch is disclosed in previously mentioned U.S. Pat. No. 3,898,398, and an example of a suitable cut-out switch is disclosed in previously mentioned U.S. Pat. No. 3,786,892. In the preferred embodiment, the right side of the cover 54 includes a slanted portion 74 having therein a pair of openings 76, and tne ignition switches each include an externally threaded portion extending through one of the openings 76, and a nut 78 threaded onto the externally threaded portion to secure the switch to the cover 54.

Figure 3:
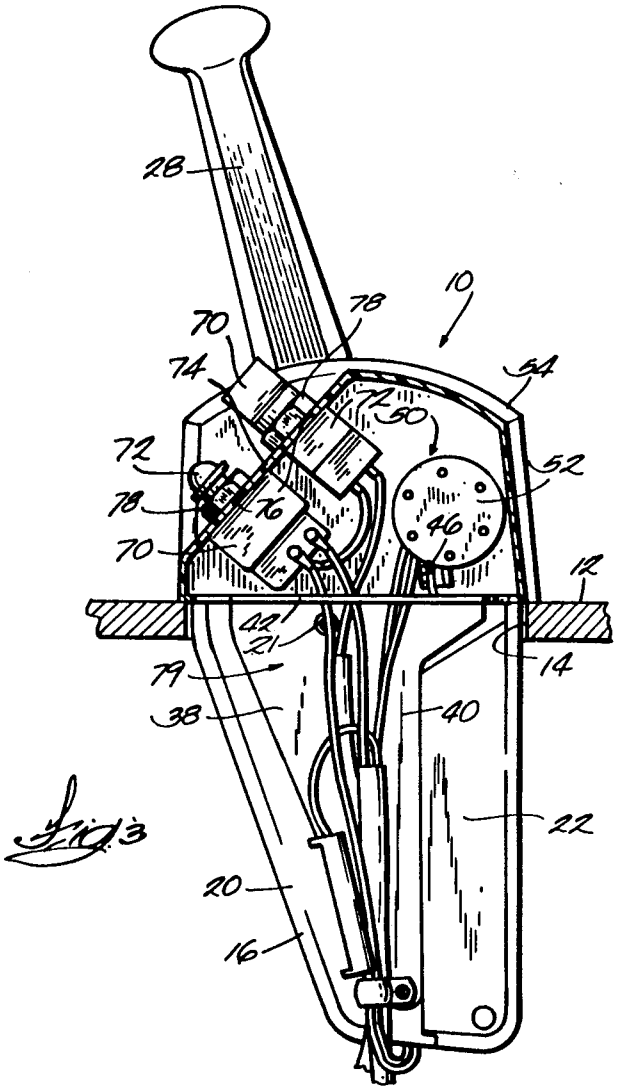
FIG. 3 is a right side view, partially cut away, of the binnacle control.

In the preferred embodiment, both of the ignition switches 70 and 72 are electrically operated, and the binnacle control 10 further comprises electrical wiring 79 operably connected to each of the warning horn 52, tne cut-out switch 72, and the on/off switch 70 and adapted to be operably connected to a marine propulsion device. In the illustrated construction, as best shown in FIG. 5, the binnacle control 10 further comprises a conventional neutral start switch 80 operably connected to the shift member 36. As is known in the art, the neutral start switch 80 is connected in series to the on/off switch 70 and allows starting of the marine propulsion device only when the shift lever 32 is in neutral. The electrical wiring 79 includes electrical wires connected to each of the neutral start switch 80 (FIG. 5) and the warning horn 52, the on/off switch 70, and tne cut-out switch 72 (FIG. 3). Preferably, the wiring from the ignition switches 70 and 72 and the warning horn 52 extends through the opening 44 in the mounting bracket horizontal portion 42, and tne wiring from the neutral start switch 80 extends through the lower end of the housing 16 (FIG. 5).

The binnacle control 10 can be manufactured with tne electrical wiring 79 already connected so that installation of the binnacle control 10 requires only mounting of the binnacle control 10 on the mounting surface 12, connection of tne electrical wiring 79 to the marine propulsion device, and connection of the push-pull cables between the binnacle control 10 and the marine propulsion device.

Other features and advantages of the invention are set forth in the following claims.

I claim:

1. A single lever control adapted to be mounted on a generally horizontal mounting surface having therein an opening, said control comprising a housing which is adapted to extend through the opening and which includes an upper portion adapted to extend above the mounting surface, and a lower portion adapted to extend below the mounting surface, an operating mechanism including a clutch control member movably mounted on said housing, a throttle control member movably mounted on said housing, and a control level pivotally mounted on said upper portion of said housing and operably connected to said throttle control member and to said clutch control member, a mounting bracket mounted on said housing, said mounting bracket including a vertical portion fixedly connected to said lower portion of said housing and adapted to extend through the opening, and a horizontal portion adapted to be connected to the mounting surface adjacent the opening, warning means mounted exteriorly of said housing on said mounting bracket and adapted to be operably connected to an engine for providing a warning signal when an engine condition exceeds a predetermined value, said warning means being mounted on said horizontal portion of said mounting bracket, a cover connected to said housing and including means for engaging the mounting surface, said cover partially enclosing said upper portion of said housing and enclosing said warning means, and said cover enclosing said horizontal portion of said mounting bracket and being adapted to be fixedly connected with said horizontal portion of said mounting bracket to the mounting surface, and an ignition switch mounted on said cover and adapted to be operably connected to an engine ignition system.

2. A single lever control adapted to be mounted on a generally horizontal mounting surface having therein an opening, said control comprising a housing which is adapted to extend through the opening and which includes an upper portion adapted to extend above the mounting surface, and a lower portion adapted to extend below the mounting surface, said housing including a flange extending generally horizontally from said upper portion, having therein an aperture, and being adapted to be connected to the mounting surface adjacent the opening, an operating mechanism including a clutch control member movably mounted on said housing, a throttle control member movably mounted on said housing, and a control lever pivotally mounted on said upper portion of said housing and operably connected to said throttle control member and to said clutch control member, a mounting bracket mounted on said housing, warning means mounted exteriorly of said housing on said mounting bracket and adapted to be operably connected to an engine for providing a warning signal when an engine condition exceeds a predetermined value, a cover connected to said housing and including means for engaging the mounting surface, said cover partially enclosing said upper portion of said housing and enclosing said warning means, and said cover enclosing said flange and including a portion in registry with said flange and having therein an aperture adapted for passage therethrough of a fastener which also passes through said aperture of said flange so as to fix said cover and said housing to the mounting surface, and an ignition switch mounted on said cover and adapted to be operably connected to an engine ignition system.

3. A single lever control adapted to be mounted on a generally horizontal mounting surface having an opening therein, said control comprising a housing adapted to extend through the opening, and an operating mechanism located in said housing and including an engine throttle control member, and a clutch control member, a control lever pivotally mounted on said housing and operably connected to said engine throttle control member and to said clutch control member, a mounting bracket including a vertical portion fixedly connected to said housing and adapted to extend through the opening, and a horizontal portion adapted to be connected to the mounting surface adjacent the opening, warning means mounted on said horizontal portion of said mounting bracket and adapted to be operably connected to an engine for providing a warning signal when an engine condition exceeds a predetermined value, and a cover connected to said housing and to said mounting bracket and adapted to be mounted on the mounting surface, said cover partially enclosing said housing and enclosing said warning means.

4. A control as set forth in claim 3 and further comprising an ignition switch mounted on said cover and adapted to be operably connected to an engine ignition system.

5. A control as set forth in claim 4 wherein said ignition switch is an on/off ignition switch, and wherein said binnacle control further comprises an ignition cut-out switch mounted on said cover and adapted to be operably connected to tne engine ignition system.

6. A control as set forth in claim 5 wherein said warning means, said on/off switch, and said cut-out switch are electrically operated, and wherein said binnacle control further comprises electrical wiring operably connected to each of said warning means, said on/off switch, and said cut-out switch and adapted to be operably connected to a marine propulsion device.

7. A control as set forth in claim 3 wherein said housing includes an upper portion adapted to extend above the mounting surface, and a lower portion adapted to extend below the mounting surface, wherein said control lever is pivotally mounted on said upper portion of said housing, and wherein said cover encloses said upper portion of said housing.

8. A control as set forth in claim 7 wherein said mounting bracket is connected to said lower portion of said housing, and wherein said cover encloses said horizontal portion of said mounting bracket and is adapted to be fixedly connected with said horizontal portion of said mounting bracket to the mounting surface.

9. A control as set forth in claim 7 wherein said housing has first and second sides, wherein said mounting bracket is connected to said second side of said housing, wherein said housing includes a flange extending generally horizontally from said first side of said upper portion and being adapted to be connected to the mounting surface adjacent the opening, and wherein said cover encloses said flange and includes a portion in registry with said flange and adapted for passage therethrough of a fastener which also passes through said flange so as to fix said cover and said housing to the mounting surface.

10. A control as set forth in claim 3 wherein said warning means includes an electric horn operable in response to an engine temperature above a predetermined value.

11. A single lever control adapted to be mounted on a generally horizontal mounting surface having an opening therein, said control comprising a housing adapted to extend through the opening and including an interior, an upper portion adapted to extend above the mounting surface and including opposed first and second sides, a lower portion adapted to extend below the mounting surface and including opposed first and second sides corresponding to said first and second sides of said upper portion, and a flange extending generally horizontally from said first side of said upper portion and being adapted to be connected to the mounting surface adjacent the opening, a control lever pivotally mounted on said upper portion of said housing, a throttle lever movably mounted inside said housing and adapted to be operably connected to a push-pull cable for actuating a marine engine throttle, means operably connecting said control lever to said throttle lever for causing movement of said throttle lever in response to pivotal movement of said control lever, a shift lever movably mounted inside said housing and adapted to be operably connected to a push-pull cable for actuating a marine engine clutch, means operably connecting said control lever to said shift lever for causing movement of said shift lever in response to pivotal movement of said control lever, a mounting bracket including a vertical portion fixedly connected to said second side of said lower portion of said housing and adapted to extend through the opening, and a horizontal portion adapted to be connected to the mounting surface adjacent the opening, an electrically operated warning horn mounted on said horizontal portion of said mounting bracket and adapted to be operably connected to a marine engine for providing a warning signal when the temperature of the engine exceeds a predetermined value, a cover enclosing said upper portion of said housing, said flange, said horizontal portion of said mounting bracket, and said warning horn, said cover being adapted to be fixedly connected with said flange and with said horizontal portion of said mounting bracket to the mounting surface, and said cover including a slot receiving said control lever and facilitating placement of said cover over said housing and said control lever, an electrically operated ignition cut-out switch mounted on said cover and adapted to be operably connected to a marine engine ignition system, an electrically operated on/off ignition switch mounted on said cover and adapted to be operably connected to the marine engine ignition system, and electrical wiring operably connected to each of said warning horn, said cut-out switch, and said on/off switch and adapted to be operably connected to a marine propulsion device.

* * * * *